United States Patent [19]

Fletcher

[11] 3,943,824

[45] Mar. 16, 1976

[54] HYDRAULIC SYSTEM

[75] Inventor: Edward Horton Fletcher, Waterloo, Iowa

[73] Assignee: Deere & Company, Moline, Ill.

[22] Filed: Jan. 22, 1975

[21] Appl. No.: 542,893

[52] U.S. Cl. ..... 91/363 A; 91/420; 91/447

[51] Int. Cl.[2] ..... F15B 9/03; F15B 9/09

[58] Field of Search ..... 91/447, 363 A, 420

[56] References Cited

UNITED STATES PATENTS

| | | | |
|---|---|---|---|
| 2,618,121 | 11/1952 | Tucker | 91/447 |
| 2,770,098 | 11/1956 | Korkowski et al. | 91/447 |
| 3,826,174 | 7/1974 | Platt | 91/363 A |
| R24,006 | 5/1955 | Acton | 91/447 |

*Primary Examiner*—Paul E. Maslousky

[57] ABSTRACT

An electro-hydraulic system for controlling a hydraulic function includes a pump and reservoir connected to the function through an electro-hydraulic control valve, a pair of pilot operated check valves normally preventing fluid flow from the function, a pilot passage between the pump and check valves to pressurize and open the check valves, an electro-hydraulic drain valve connected to the pilot passage, and control means for the control and drain valves. The control means is responsive to a feedback signal from the hydraulic function and an operator-controlled input signal within a predetermined range to close and open the drain and control valves, respectively. The control means may further require the presence of a second input signal, such as a simple reference signal or a signal provided in response to operation of an additional function, before operating the control and drain valves. With this arrangement, the system is fail-safe inasmuch as the hydraulic function will not operate in the event of hydraulic or electrical failure, if the hydraulic function and the operator input signal difference is above or below predetermined maximum and minimum values, or in the absence of the second input signal.

24 Claims, 1 Drawing Figure

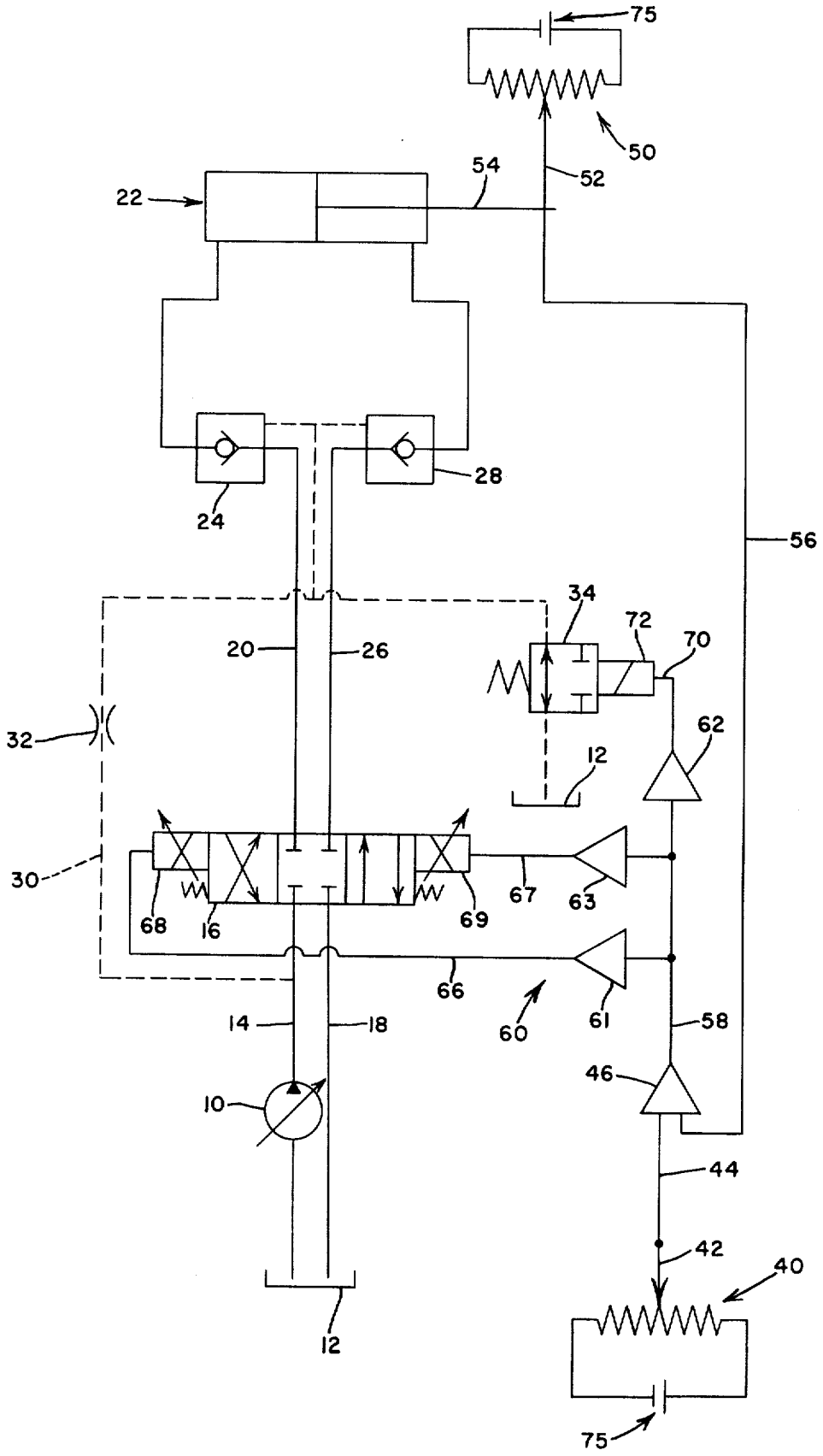
75
50
52
54
22
28
24
56
34
72
70
20
26
32
62
12
30
68
16
69
67
63
66
60
61
58
14
18
10
46
44
42
40
12
75

HYDRAULIC SYSTEM

BACKGROUND OF THE INVENTION

The present invention relates generally to hydraulic systems and more particularly to electro-hydraulic systems.

In the past, various types of electro-hydraulic control systems have been developed, some employing mechanical, electrical or hydraulic feedback means, but none included provisions for preventing any movement of the hydraulic function in the event of any one or combination of mechanical, electrical or hydraulic failure.

SUMMARY OF THE INVENTION

It is a general object to provide an electro-hydraulic system incorporating combined electric and hydraulic circuitry to prevent movement of a hydraulic function upon the failure of electric or hydraulic power or if predetermined parameters are not satisfied.

The above and additional objectives and advantages of the invention will become apparent to those skilled in the art by a reading of the following detailed description of a preferred embodiment of the invention when taken in conjunction with the accompanying drawings.

BRIEF DESCRIPTION OF THE DRAWINGS

The drawing is an electrical and hydraulic schematic illustrating the features of the present invention.

DESCRIPTION OF THE PREFERRED EMBODIMENT

Referring now to the drawing, the hydraulic system according to the invention includes a main variable displacement, pressure compensated, hydraulic pump 10 supplied from a reservoir 12 and supplying pressurized fluid through a supply line 14 to a first port in the first side of a control valve 16. A reservoir line 18 connects a second port in the first side of the control valve 16 with the reservoir 12.

A first port in the second side of the control valve 16 is connected by a first fluid passage 20 to a first port in a fluid motor or hydraulic cylinder 22. The hydraulic cylinder 22 is representative of any of the conventional hydraulic functions. Interposed in the first fluid passage 20 between the cylinder 22 and the control valve 16 is a first conventional pilot-operated check valve 24. A second port in the second side of the control valve 16 is connected to a second port in the rod end of cylinder 22 by a second fluid passage 26 and interposed in the second fluid passage 26 between the control valve 16 and the cylinder 22 is a second conventional pilot-operated check valve 28.

A pilot passage 30 is connected to the supply line 14 and to the pilots of the check valves 24 and 28. A restrictor 32 is interposed in the pilot passage 30 between the supply line 14 and the check valves 24 and 28. A solenoid operated, normally-open drain valve 34 which opens to the reservoir 12 is connected to the pilot passage 30 between the restrictor 32 and the check valves 24 and 28.

The operator input occurs at a manually operable selector potentiometer 40 which is connected to a power source 75 and which includes a selector wiper 42 connected by an operator's command lead 44 to a difference amplifier circuit 46 of known circuit configuration. The output of the cylinder 22 is sensed by a motor sensor potentiometer 50 which is connected to the source 75 and which includes an output wiper 52 mounted on a cylinder rod 54 of the cylinder 22. An output sensor lead 56 connects the motor sensor potentiometer 50 to the difference amplifier circuit 46.

A difference signal lead 58 connects the difference amplifier circuit 46 to amplifier means 60 which includes first, second, and third "windowed" amplifier circuits 61, 62, and 63 of known circuit configurations. A first control valve lead 66 connects the first amplifier circuit 61 with an operator means or a first control valve solenoid 68 for selectively moving the control valve 16 to one side of a center-off position to connect the first fluid passage 20 to the reservoir 12 and the second fluid passage 26 to the pump 10. A second control valve lead 67 connects the third amplifier circuit 63 with an operator means or a second control valve solenoid 69 for selectively moving the control valve 16 to another side of the center-off position to connect the first fluid passage 20 to the pump 10 and the second fluid passage 26 to the reservoir 12.

A drain valve lead 70 connects the second amplifier circuit 62 to an operator means or drain valve solenoid 72 which moves the drain valve 34 for selectively connecting and blocking the pilot passage 30 to and from the reservoir 12.

If desired, the reference voltages for the difference amplifier circuit 46, or the first and third amplifier circuits 61 and 63, or the second amplifier circuit 62 can be used as additional input signals as will be well understood by those skilled in the art. For example, the reference voltages can be altered by a signal to an electro-hydraulic control valve for an additional function so that the second amplifier circuit 62 will not provide signals to the drain valve solenoid 72 unless the control valve for the additional function is actuated, thus requiring sequential or simultaneous operation of the functions. The requirement for actuation of the additional functions or similar requirement can be referred to as programed or predetermined parameters.

In the following description of operation the presence of reference voltages for the amplifier circuits will be assumed except where noted.

To operate the hydraulic system, the operator moves the selector wiper 42 to a desired position which produces a signal proportional to that position and sends the signal to the control means which includes the amplifier circuits 46, 61, 62 and 63, and the solenoids 68, 69, and 72. Starting in the difference amplifier circuit 46 the selector signal is compared with the signal produced by the output wiper 52 of the motor sensor potentiometer 50 representative of the position of the cylinder rod 54.

When the selector signal is greater than the motor sensor signal, a positive difference signal is produced by the difference amplifier circuit 46. It should be noted that the difference signal is described herein as positive, negative, or null, but that the polarity and value of the various signals may be chosen to suit the application as would be evident to one skilled in the art.

Although all three amplifier circuits 61, 62, and 63 receive all the difference signals, each amplifier circuit restricts activation and amplification to those difference signals which fall within predetermined "windows" or ranges established for each amplifier circuit. A positive difference signal which indicates a significant difference and which does not indicate a substantial difference, as would be evident to one skilled in the art, falls within the positive "window" or a first predetermined range of difference signals established for the third amplifier circuit 63. This difference signal is amplified by the third amplifier circuit 63 to produce an amplified positive signal. The amplified positive signal activates the second control valve solenoid 69 so as to move the control valve 16 to connect the first fluid passage 20 to the pump 10 and the second fluid passage 26 to the reservoir 12.

Simultaneously, the second amplifier circuit 62 which also amplifies signals within the first predetermined range of difference signals amplifies the positive difference signal so as to provide an amplified positive signal to activate the drain valve solenoid 72 to position the drain valve 34 to block the pilot passage 30 from the reservoir 12. This permits the fluid pressure in the pilot passage 30 to increase and operate the pilots in and open the check valves 24 and 28. When the check valves 24 and 28 are open, the pump 10 supplies pressurized fluid to the first port of the cylinder 22 and the second port of cylinder 22 is connected to the reservoir 12 causing the cylinder rod 54 to extend.

When the selector signal is less than the motor sensor signal, a negative difference signal is produced by the difference amplifier 46. A negative difference signal within a negative "window" or second predetermined range of difference signals is amplified by the first amplifier circuit 61 to produce a negative signal which activates the first control valve solenoid 68 to shift the control valve 16 to the position wherein the first fluid passage 20 is connected to the reservoir 12 and the second fluid passage 26 is connected to the pump 10.

Simultaneously, the second amplifier circuit 62, which amplifies and changes the signals within the second predetermined range of difference signals, processes the negative difference signal to produce an amplified positive signal to activate the drain valve solenoid 72 to block the pilot passage 30 from the reservoir 12. Thus, the check valves 24 and 28 are opened to connect the pump 10 to the second port of cylinder 22 and the reservoir 12 to the first port causing the cylinder rod 54 to retract.

When the two signals are approximately equal and there is only a slight difference, the difference signal produced falls between the first and second predetermined ranges so that a null signal or no signal is produced by the amplifier means 60. This in turn means that the control valve solenoids 68 and 69 and the drain valve solenoid 72 are not activated and the control valve 16 and the drain valve 34 are in their center-off and open-to-reservoir positions, respectively. With the control valve 16 in the center-off position both the pump 10 and the reservoir 12 are disconnected from the first and second fluid passages 20 and 26. The fluid pressure in the pilot passage 30 between the restrictor 32 and check valves 24 and 28 is not sufficient to operate the pilots because the drain valve 34 connects the pilot passage 30 to the reservoir 12 and the restrictor 32 prevents pressure buildup. Thus, the cylinder rod 54 is prevented from moving.

In the event that there is a substantial difference between the selector signal and the motor sensor signal, the difference signal will be outside the first and second predetermined ranges of difference signals so that the null signal will be produced by the amplifier means 60 and movement of the cylinder rod 54 is prevented. Substantial differences would occur when there is an over-shoot such as when either the selector wiper 42 or the cylinder rod 54 is moved too rapidly for the other to follow, or when the positions of the cylinder rod 54 and the selector wiper 42 are substantially misaligned during a shutdown of the system and remain misaligned after startup.

In the event of a mechanical failure such as the jamming of either the control valve 16 or the drain valve 34, the operative valve would still be capable of stopping the cylinder 22. If the control valve 16 jams in an open position, the drain valve 34 will reduce the pressure in the pilot line 30 causing the first and second check valves 24 and 28 to close and prevent the flow of fluid to and from the cylinder 22. If the drain valve 34 jams in an open position, the pressure in the pilot line 30 will be reduced causing the first and second check valves 24 and 28 to close; and, if the drain valve 34 jams in a closed position, a variation of the output wiper 52 from the setting of the selector wiper 42 will cause the centering of the control valve 16 in the off position to prevent flow to and from the cylinder 22.

In the event of an electrical power failure, the signals to the operator means 68 and 72 will null, causing the control valve 16 to move to its neutral ports-blocked position, and the drain valve 34 to connect the pilot passage 30 to the reservoir 12. Thus, movement of the cylinder rod 54 will be prevented by the closing of the check valves 24 and 28 and by the disconnection of the first and second fluid passages 20 and 26 from the pump 10 and the reservoir 12.

In the event of hydraulic power failure while electrical power is available, the fluid pressure in the pilot passage 30 will decrease closing the first and second check valves 24 and 28 and preventing flow through the first and second fluid passages 20 and 26 regardless of the position of control valve 16. A combined hydraulic and electrical power failure will result in both the check valves 24 and 28 closing and the control valve 16 centering in the off position.

If the reference voltages for the amplifier means 60 are being used as additional input signals to indicate the fulfillment of programed parameters, a signal from the difference amplifier circuit 46 will not result in a signal from the amplifier means 60 unless the parameter is fulfilled and the reference voltages or signals are applied to the amplifier means 60.

Thus, an electro-hydraulic system has been presented wherein a hydraulic function is responsive to the position of an operator's selector and wherein movement of the function will be stopped upon a mechanical, electrical, or hydraulic failure; or in the absence of the fulfillment of programed parameters.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations that fall within the spirit and the scope of the intended claims.

I claim:

1. A hydraulic system comprising: a fluid reservoir; a source of pressurized fluid; fluid function means providing an output and having at least one port; fluid passage means connected to the port; function control means operatively associated with the source for controlling the pressurized fluid in the fluid passage means; pilot operated check valve means disposed in the fluid passage means normally preventing flow of fluid away from the function means and including pressure responsive means to open the check valve means and permit the flow of fluid away from the function means when supplied with pressurized fluid; pilot passage means connected to the pressure responsive means; pressure control means exclusive of the function control means for the pilot passage means for selectively pressurizing and exhausting the pilot passage means; manually operable means providing an input proportional to desired function means output; and control means operatively associated with the function control means and the pressure control means responsive to the manually operable means input to connect the fluid passage means to the source and to pressurize the pilot passage means in response to the presence of the input.

2. A hydraulic system as claimed in claim 1 wherein the function control means includes control valve means operatively associated with the fluid passage means for selectively interconnecting the reservoir and source thereto, the pilot passage means connects the pressure responsive means to the source, and the pressure control means includes drain valve means connected to the pilot passage means for selectively connecting and blocking the pilot passage means to and from the reservoir.

3. A hydraulic system as claimed in claim 1 wherein the manually operable means includes selector means for providing an input signal proportional to the desired function means output; amplifier means in the control means connected to the selector means for amplifying the signals therefrom; operator means in the control means associated with the control valve means responsive to the amplified signal from the amplifier means to connect the fluid passage means to the source; and operator means in the control means associated with the pressure control means responsive to the amplified signal from the amplifier means to block the pilot passage means from the reservoir.

4. A hydraulic system as claimed in claim 3 wherein the amplifier means includes means responsive to programed parameters to selectively effect amplification of the selector means signal.

5. A hydraulic system as claimed in claim 3 including restrictor means interposed in the pilot passage means between the source and the pressure control means preventing buildup of pressurized fluid sufficient to operate the check valve means while the drain valve means is connected to the reservoir.

6. A hydraulic system comprising: a fluid reservoir; a source of pressurized fluid; hydraulic function means providing an output and having at least one port; fluid passage means connected to the port; control valve means operatively associated with the fluid passage means for selectively interconnecting the reservoir and the source thereto; pilot operated check valve means disposed in the fluid passage means normally preventing flow of fluid from the function means to the control valve means and including pressure responsive means to open the check valve means and permit the flow of fluid from the function means to the control valve means when supplied with pressurized fluid; pilot passage means connecting the pressure responsive means to the source; drain valve means connected to the pilot passage means for selectively connecting and blocking the pilot passage means to and from the reservoir; manually operable selector means providing a signal proportional to desired function means output; function sensor means operatively associated with the function means for sensing function means output and providing a signal proportional thereto; and control means operatively associated with the control valve means and the drain valve means responsive to the signals from the selector means and the function sensor means to connect the fluid passage means to the source in response to a predetermined difference between the signals and to connect and block the pilot passage means to and from the reservoir in response to the absence and the presence of a difference, respectively, between the signals.

7. A hydraulic system as claimed in claim 6 wherein the control means includes difference means responsive to the difference between the selector means signal and the function sensor means signal to provide a difference signal; amplifier means connected to the difference amplifier means for amplifying the difference signals therefrom; operator means associated with the control valve means responsive to the amplified difference signals from the amplifier means to connect the fluid passage means to the source; and operator means associated with the drain valve means responsive to the amplified difference signals from the amplifier means to block the pilot passage means from the reservoir.

8. A hydraulic system as claimed in claim 7 wherein the difference amplifier means includes means responsive to programed parameters to selectively effect the providing of the difference signal.

9. A hydraulic system as claimed in claim 7 wherein the amplifier means includes means responsive to programed parameters to selectively effect amplification of the difference signal.

10. A hydraulic system as claimed in claim 7 wherein the amplifier means includes means for restricting amplification of the difference signals affecting the operator means associated with the control valve means to the difference signals within a predetermined range of difference signals.

11. A hydraulic system as claimed in claim 7 wherein the amplifier means includes means for restricting amplification of the difference signals affecting the operator means associated with the drain valve means to the difference signals within a predetermined range of difference signals.

12. A hydraulic system as claimed in claim 11 wherein the amplifier means further includes means for restricting amplification of the difference signals affecting the operator means associated with the drain valve means to difference signals within a second predetermined range of difference signals.

13. A hydraulic system as claimed in claim 12 further including restrictor means interposed in the pilot passage means between the source and the drain valve means preventing buildup of pressurized fluid sufficient to operate the check valve means while the drain valve means is connected to the reservoir.

14. A hydraulic system comprising: a fluid reservoir; a source of pressurized fluid; hydraulic function means providing an output and having a first and second ports; first and second fluid passage means connected to the first and second ports, respectively; control valve means selectively movable to either side of a neutral position to connect the first fluid passage means to the reservoir and the second fluid passage means to the source or the first fluid passage means to the source and the second fluid passage means to the reservoir; first and second pilot operated check valve means disposed in the first and second fluid passage means, respectively, normally preventing flow of fluid from the first and second ports, respectively, to the control valve means and including pressure responsive means to open the check valve means and permit the flow of fluid from the first and second ports to the control valve means when supplied with pressurized fluid; pilot passage means connecting the pressure responsive means to the source; drain valve means exclusive of the control valve means connected to the pilot passage means for selectively connecting and blocking the pilot passage means to and from the reservoir; manually operable means providing an input proportional to desired function means output; control means operatively associated with the control valve means and the drain valve means responsive to the manually operable means input to change the interconnections of the control valve means and to interconnect and block the pilot passage means to and from the reservoir in response to the absence and presence, respectively, of the input.

15. A hydraulic system as claimed in claim 14 wherein the manually operable means includes selector means for providing an input signal proportional to the desired function means output; amplifier means in the control means connected to the selector means for amplifying signals within a first and a second predetermined range of signals therefrom; operator means in the control means associated with the control valve means responsive to the amplified signals from within the first predetermined range of signals to connect the first fluid passage means to the reservoir and the second fluid passage means to the source and responsive to the amplified signals from within the second predetermined range of signals to connect the first fluid passage means to the source and the second fluid passage means to the reservoir; and operator means in the control means associated with the drain valve means responsive to the amplified signals from within the first and second predetermined range of signals to block the pilot passage means from the reservoir.

16. A hydraulic system as claimed in claim 15 wherein the amplifier means includes means responsive to programed parameters to selectively effect amplification of the selector means signals.

17. A hydraulic system as claimed in claim 15 including restrictor means interposed in the pilot passage means between the source and the drain valve means preventing buildup of pressurized fluid sufficient to operate the check valve means while the drain valve means is connected to the reservoir.

18. A hydraulic system comprising: a fluid reservoir; a source of pressurized fluid; hydraulic function means providing an output and having a first and second ports; first and second fluid passage means connected to the first and second ports, respectively; control valve means selectively movable to either side of a neutral position to connect the first fluid passage means to the reservoir and the second fluid passage means to the source or the first fluid passage means to the source and the second fluid passage means to the reservoir; first and second pilot operated check valve means disposed in the first and second fluid passage means, respectively, normally preventing flow of fluid from the first and second ports, respectively, to the control valve means and including pressure responsive means to open the check valve means and permit the flow of fluid from the first and second ports to the control valve means when supplied with pressurized fluid; pilot passage means connecting the pressure responsive means to the source; drain valve means connected to the pilot passage means for selectively connecting and blocking the pilot passage means to and from the reservoir; manually operable selector means providing a signal proportional to desired function means output; function sensor means operatively associated with the function means for sensing function means output and providing a signal proportional thereto; and control means operatively associated with the control valve means and the drain valve means responsive to signals from the selector means and the function sensor means to connect the first fluid passage means to the reservoir and the second fluid passage means to the source in response to a difference between the signals within a first predetermined range of differences and to connect the first fluid passage means to the source and the second fluid passage means to the reservoir in response to a difference between the signals within a second predetermined range of differences and to connect and block the pilot passage means to and from the reservoir in response to the absence and the presence of a difference, respectively, between the signals.

19. A hydraulic system as claimed in claim 18 wherein the control means includes difference amplifier means responsive to the difference between the selector means and the function means signals to provide a difference signal; amplifier means connected to the difference amplifier means for amplifying difference signals within a first and second predetermined range of difference signals; operator means associated with the control valve means responsive to the amplified difference signals from the amplifier means within the first range of differences to connect the first fluid passage means to the reservoir and the second fluid passage means to the source and responsive to the amplified difference signals from the amplifier means within the second range of difference signals to connect the first fluid passage means to the source and the second fluid passage means to the reservoir; second amplifier means connected to the difference amplifier means for amplifying the difference signal therefrom; operator means associated with the drain valve means responsive to the amplified difference signal from the second amplifier means to block the pilot passage means from the reservoir.

20. A hydraulic system as claimed in claim 19 wherein the difference amplifier means includes means responsive to the presence or absence of programed parameters to respectively effect or not effect the providing of the amplified difference signal.

21. A hydraulic system as claimed in claim 19 wherein the amplifier means includes means responsive to the presence or absence of programed parameters to respectively effect or not effect amplification of the amplified difference signal.

22. A hydraulic system as claimed in claim 19 wherein the second amplifier means includes means responsive to the presence or absence of programed parameters to respectively effect or not effect amplification of the difference signal.

23. A hydraulic system as claimed in claim 19 including comparator means in the control means responsive to the difference between the selector means signal and the function sensor means signal to provide a difference signal; amplifier means in the control means connected to the comparator means for amplifying difference signals within a first and second predetermined range of difference signals therefrom; operator means associated with the control valve means responsive to the amplified difference signals from the amplifier means within the first predetermined range of difference signals to connect the first fluid passage means to the reservoir and the second fluid passage means to the source and responsive to the amplified difference signals from the amplifier means within the second predetermined range of difference signals to connect the first fluid passage means to the source and the second fluid passage means to the reservoir; and operator means associated with the drain valve means responsive to the amplified difference signals from the amplifier means within the first and second predetermined range of difference signals to block the pilot passage means from the reservoir.

24. A hydraulic system as claimed in claim 19 further including restrictor means in the pilot passage means between the source and the drain valve means preventing buildup of pressurized fluid sufficient to operate the check valve means while the drain valve means is connected to the reservoir.

* * * * *